United States Patent [19]

Howe

[11] 4,069,417

[45] Jan. 17, 1978

[54] LIGHTING PANEL HAVING IMPROVED REFRACTING ELEMENTS

[75] Inventor: James D. Howe, Rochester, N.Y.

[73] Assignee: Bausch & Lomb Incorporated, Rochester, N.Y.

[21] Appl. No.: 671,888

[22] Filed: Mar. 29, 1976

Related U.S. Application Data

[63] Continuation-in-part of Ser. No. 571,171, May 1, 1975.

[51] Int. Cl.[2] ..... F21V 5/00

[52] U.S. Cl. ..... 362/330

[58] Field of Search ..... 240/106 B, 51.11 R, 240/106 R, 106.1, 9, 9.5

[56] References Cited

U.S. PATENT DOCUMENTS

| | | | |
|---|---|---|---|
| 1,796,468 | 3/1931 | Main | 240/78 LD |
| 3,349,238 | 10/1967 | Kruger | 240/9.5 |
| 3,721,818 | 3/1973 | Stahlhut | 240/78 LD X |
| 3,794,829 | 2/1974 | Taltavull | 240/106 R |
| 3,866,036 | 2/1975 | Taltavull | 240/51.11 R |

*Primary Examiner*—Donald A. Griffin

*Attorney, Agent, or Firm*—Bernard D. Bogdon; Frank C. Parker

[57] ABSTRACT

A lighting panel used to control locally unidirectional light passing therethrough is constructed from a plurality of light modifying elements for substantially controlling the distribution of light within a control range. Each element is constructed to critically reflect the collimated light and then refract the reflected light into at least two peak lighting intensities within the control range.

4 Claims, 3 Drawing Figures

LIGHTING PANEL HAVING IMPROVED REFRACTING ELEMENTS

CROSS-REFERENCE TO RELATED APPLICATONS

This application is a continuation-in-part of application Ser. No. 571,171, filed May 1, 1975, and is related to Application Ser. No. 632,611, "A Lighting Panel", filed Nov. 17, 1975 for inventor Thomas W. Dey.

BACKGROUND OF THE INVENTION

As is known in the lighting industry, it is desirable to provide a "bat wing" lighting distribution. It has been common practice to form this lighting distribution from a light envelope with a single peak lighting intensity. An example of such a device is disclosed in application Ser. No. 632,611, wherein the incoming collimated light is critically reflected and then refracted into a selected control range forming the "bat wing" lighting distribution.

SUMMARY OF THE INVENTION

In accordance with the present invention, a lighting panel is used to control locally unidirectional light as the light passes therethrough. The lighting panel is constructed from a plurality of light modifying elements for substantially controlling the distribution of light within a control range. Each element is constructed to critically reflect the collimated light and then refract the reflected light into at least two peak lighting intensities within the control range.

BRIEF DESCRIPTION OF THE DRAWINGS

Objects and advantages of the invention will become apparent upon reading the following detailed description and upon reference to the drawings, in which like reference numerals refer to like elements in the various views.

DETAILED DESCRIPTION OF THE PREFERRED EMBODIMENT

Figure 1:
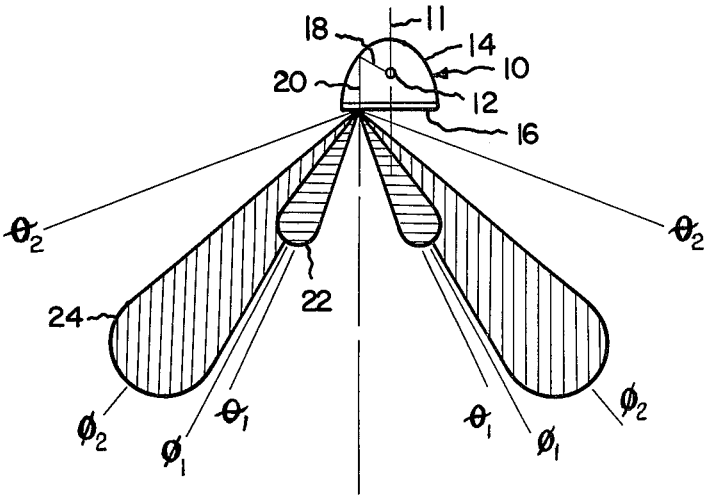
FIG. 1 is an elevational view, partly in section, of an embodiment of the invention showing the components forming a "bat wing" radial distribution of light.

As best seen in FIG. 1, a luminaire 10 has an axis of symmetry 11 (a reference design axis) and a high intensity discharge lamp 12 disposed along axis 11 and within a parabolic reflector 14. A lighting panel 16 is positioned in the aperture of reflector 14 to modify light passing therethrough. Upon activation of lamp 12, light rays, as represented by a typical light ray 18, are reflected from reflector 14 to produce locally unidirectional light rays, as represented by a typical light ray 20. Locally unidirectional light is light passing through an incremental area of the reflector's aperture in a single direction. As illustrated, the only light rays passing through panel 16 is light reflected from reflector 14, the direct passage of light from lamp 12 to panel 16 being masked. In the preferred embodiment and as illustrated, substantially collimated light is provided across the reflector's aperture. Substantially collimated light means light rays limited to a maximum and minimum deflection from the design axis 11 of ± 25°.

As light ray 20 passes through lighting panel 16, a first lighting envelope 22 is formed about an angle $\phi_1$ and a second lighting envelope 24 is formed about an angle $\phi_2$. The angles $\phi_1$ and $\phi_2$ extend through the first and second peak lighting intensities, respectively. The "bat wing" lighting distribution is thus formed by the first and second lighting envelopes 22 and 24. Accordingly, the two peak lighting intensities, lying along $\phi_1$ and $\phi_2$ are required to be within a control range of a minimum angle, $\theta_1$, and a maximum angle, $\theta_2$. Preferably, $\theta_1$ is approximately 25° and $\theta_2$ is approximately 60°.

Figure 2:
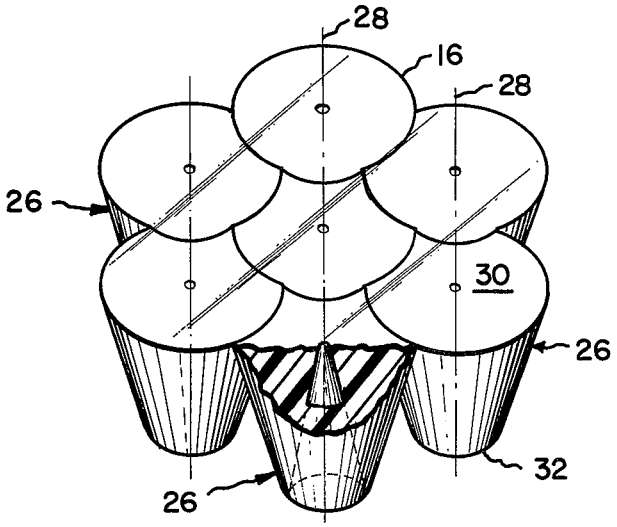
FIG. 2 is an enlarged perspective view of an array of light modifying elements embodying the invention.
Figure 3:
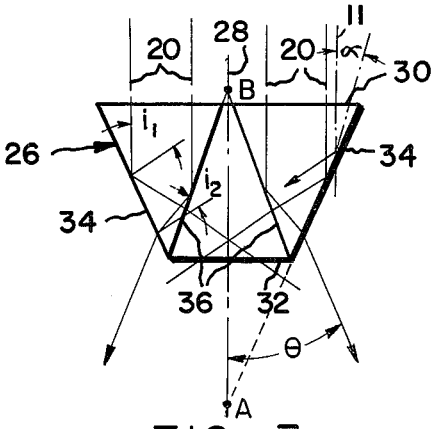
FIG. 3 is a sectional elevational view of a single element of the invention.

As illustrated in FIGS. 2 and 3, lighting panel 16 is constructed from an array of light modifying elements 26. Each element 26 appears as a truncated cone in an elevational view and has an axis of symmetry 28, a base 30, a truncated end 32 and an outside surface 34. Preferably, base 30 of each element 26 is the incremental area for the locally unidirectional light and faces incoming light ray 20 with truncated end 32 being directed outwardly of incoming light. Since the light being controlled is preferably substantially collimated light, axis of symmetry 28 for each element lies substantially parallel to axis of symmetry 11 of luminaire 10. Outside surface 34 of each light modifying element 26 generally tapers from base 30 toward a point A on the axis of symmetry. An inside portion of each element 26 is removed to form an inside surface 36. Although the number of peak lighting intensities may be varied by varying the number of inside surfaces for critically reflecting and then refracting light, it is preferred to provide only two peak lighting intensities with each element 26. Therefore, inside surface 36 is generally tapered from outside surface 34 toward a point B on axis of symmetry 28, thereby, forming a conical shape of the removed portion with the base forming truncated end 32 and the sides forming inside surface 36.

The two peak lighting intensities are obtained by the incoming light being critically reflected from outside surface 34 or inside surface 36 and then refracted at inside surface 36 or outside surface 34, respectively as illustrated in FIG. 3. The amount of tapering for each surface, the angles between the axis of symmetry and the inside and outside surfaces, necessary to provide critical reflection and then refraction depends on several control factors. These control factors have been set forth in application Ser. No. 632,611 and are basically governed by two formulas. A first formula, Formula I, insures critical reflection and then refraction at surfaces 34 and 36 of each element 26. A second formula, Formula II, insures that the range of the reflected light is substantially controlled between angles $\theta_1$ and $\theta_2$. Formula II is a "set" equation defining the range of values for $\theta$'s having the Greatest Lower Bound and the Least Upper Bound of $\theta_1$ and $\theta_2$, respectively. Formulas I and II are as follows:

$$i_1 > \arcsin(1/N) > |i_2| \qquad \text{I:}$$

$$\{\theta\} \equiv \text{Ⓕ}\ \theta \cdot 3 \cdot \qquad \text{II}$$

$$\theta = \alpha + \pi - 2i_1 + i_2 - \arcsin(N \sin i_2)$$

$i_1$ = the angle of incidence of any selected locally unidirectional light ray impinging on surfaces 34 or 36;

$i_2$ = the angle of incidence of a reflected light ray impinging on surfaces 34 or 36;

N = index of refraction;

$\theta$ = the angle of deflection between any selected light ray leaving element 26 and the design reference axis;

$\alpha$ = the angle of deflection between any selected unidirectional light ray impinging on surfaces 34 or 36 and the design reference axis;

$\theta_1$ = the minimum deflection angle within the control range; and $\theta_2$ = the maximum deflection angle within the control range.

The two peak lighting intensities are varied by changing the amount of tapering for outside surface 34 relative to inside surface 36, thereby varying $\phi_1$ and $\phi_2$. Also, envelope 22 increases relative to envelope 24 as the cross-sectional area of truncated end 32 increases relative to the cross-sectional area of base 30. An example of a lighting panel having modifying elements which provide first lighting envelope 22 with 27% of the light and $\phi_1$ peaking at 28° and second lighting envelope 24 with 73% of the light and $\phi_2$ peaking at 40° was obtained from an acrylic plastic with an index of refraction of 1.49, an angle formed between outside surface 34 and axis of symmetry 28 of 25° 5′ and an angle formed between the inside surface 36 and axis of symmetry 28 of 20° 35′.

It is claimed:

1. A lighting panel useable in controlling locally unidirectional light passing therethrough to uniformly radially distribute the light into each of at least two peak lighting intensities within the control range to improve illumination, comprising:

a plurality of light modifying elements for substantially uniformly controlling the radial distribution of locally unidirectional light within a control range, each element being constructed to critically reflect the incoming locally unidirectional light and then refract the reflected light into at least two uniformly radially distributed peak lighting intensities having substantially uniform radial light distribution within each of the peak lighting intensities within the control range.

2. The lighting panel as defined in claim 1, wherein each element has an axis of symmetry substantially parallel to the locally unidirectional light, a base directed toward incoming locally unidirectional light, an outside surface disposed symmetrically about the axis and generally tapering from the base of the element toward a point on the axis of symmetry and at least one inside surface disposed symmetrically about the axis and generally tapering from a location on the outside surface of the element toward a point on the axis of symmetry, the inside and outside surfaces of the element being constructed to critically reflect the incoming light and then refract the reflected light into at least two peak lighting intensities within the control range.

3. The lighting panel as defined in claim 2, wherein each element is a truncated cone when viewed in elevation.

4. A lighting panel useable in controlling substantially collimated light passing therethrough, comprising:

a plurality of light modifying elements for substantially controlling the distribution of light within a control range, each element having an axis of symmetry lying substantially parallel to incoming substantially collimated light, a base directed toward the incoming substantially collimated light, a symmetrical outside surface generally tapering from the base toward a point on the axis of symmetry and at least one symmetrical inside surface generally tapering from a location on the outside surface toward a point on the axis of symmetry, the inside and outside surfaces being constructed to critically reflect the incoming light and then refract the reflected light into at least two peak lighting intensities within the control range.

* * * * *

UNITED STATES PATENT AND TRADEMARK OFFICE

CERTIFICATE OF CORRECTION

PATENT NO. : 4,069,417

DATED : January 17, 1978

INVENTOR(S) : James D. Howe

It is certified that error appears in the above-identified patent and that said Letters Patent are hereby corrected as shown below:

Col.2, line 59, underline "I";

line 60, underline "II"; and line 60, should read " $\{\theta\} \equiv \forall \theta \quad \cdot 3 \cdot$ ".

Signed and Sealed this

Sixteenth Day of May 1978

[SEAL]

Attest:

RUTH C. MASON
Attesting Officer

LUTRELLE F. PARKER
Acting Commissioner of Patents and Trademarks